US005879035A

United States Patent [19]

Jancsek et al.

[11] Patent Number: 5,879,035

[45] Date of Patent: Mar. 9, 1999

[54] CABINET LATCH

[75] Inventors: John J. Jancsek, Blaine; Bruce W. Larson, Andover, both of Minn.

[73] Assignee: Hoffman Enclosures, Inc., Anoka, Minn.

[21] Appl. No.: 787,079

[22] Filed: Jan. 22, 1997

[51] Int. Cl.[6] ..... E05C 3/04

[52] U.S. Cl. ..... 292/202; 292/197; 292/204

[58] Field of Search ..... 292/202, 204, 292/DIG. 21, DIG. 31, DIG. 20, 197

[56] References Cited

U.S. PATENT DOCUMENTS

| | | | |
|---|---|---|---|
| D. 131,217 | 1/1942 | Braun . | |
| D. 197,050 | 12/1963 | Orenstein . | |
| D. 292,171 | 10/1987 | Berg . | |
| D. 332,904 | 2/1993 | Plummer et al. . | |
| D. 343,347 | 1/1994 | Lau et al. . | |
| 739,300 | 9/1903 | Essig | 292/DIG. 30 |
| 980,467 | 1/1911 | Witham . | |
| 1,236,914 | 8/1917 | Coté . | |
| 1,513,234 | 10/1924 | Fritsch | 292/204 |
| 1,559,189 | 10/1925 | Shaw . | |
| 1,724,025 | 8/1929 | Jacobi . | |
| 1,747,383 | 2/1930 | Norviel . | |
| 1,788,666 | 1/1931 | Enders | 292/DIG. 20 |
| 1,789,756 | 1/1931 | Jacobi . | |
| 1,878,544 | 9/1932 | Schmidt | 292/202 |
| 1,909,393 | 5/1933 | Diesel . | |
| 2,018,098 | 10/1935 | Sullivan . | |
| 2,036,764 | 4/1936 | Lowe . | |
| 2,316,956 | 4/1943 | Heath . | |
| 2,422,723 | 6/1947 | Fisher | 292/204 |
| 2,726,889 | 12/1955 | Lawson . | |
| 2,733,089 | 1/1956 | Grevengoed . | |
| 3,170,701 | 2/1965 | Hoover . | |
| 3,374,649 | 3/1968 | Weidman . | |
| 3,500,668 | 3/1970 | Henry . | |
| 3,508,423 | 4/1970 | Jackes et al. . | |
| 3,510,182 | 5/1970 | Cowles . | |
| 3,808,850 | 5/1974 | Walters . | |
| 3,889,498 | 6/1975 | Harrell . | |
| 3,951,444 | 4/1976 | Shull | 292/204 |
| 3,995,464 | 12/1976 | Terry . | |

(List continued on next page.)

FOREIGN PATENT DOCUMENTS

| | | | |
|---|---|---|---|
| 81685 | 11/1920 | Anguilla . | |
| 759.232 | 1/1934 | France . | |
| 809.075 | 2/1937 | France . | |
| 1.147.327 | 11/1957 | France . | |
| 1.554.905 | 1/1969 | France . | |
| 2 441 704 | 6/1980 | France . | |
| 286041 | 7/1915 | Germany . | |
| 643435 | 4/1937 | Germany . | |
| 88 04 160.3 | 9/1988 | Germany . | |
| 37 10563 C2 | 7/1992 | Germany . | |
| 93 05 893.4 | 7/1993 | Germany . | |
| 11665 | of 1907 | United Kingdom | 292/204 |
| 414490 | 8/1934 | United Kingdom | 292/204 |
| WO 92/02703 | 2/1992 | WIPO . | |

OTHER PUBLICATIONS

Hoffman Engineering Company Specifier's Guide, 1995–1996, p. 502, showing lock kits for enclosures and junction boxes.

Hoffman Engineering Company Specifier's Guide, 1995–1996, pp. 574–575, showing handles, latches and clamps for use on Hoffman custom enclosures.

Hoffman Engineering Company Specifier's Guide, 1995–1996, p. 30, showing door accessories.

(List continued on next page.)

*Primary Examiner*—Steven Meyers
*Assistant Examiner*—Teri Pham
*Attorney, Agent, or Firm*—Merchant, Gould, Smith, Edell, Welter & Schmidt

[57] ABSTRACT

The present invention is directed to a cabinet latch that may be used with a slave door. The latch includes a handle member and a bearing member at substantially right angles to one another. The bearing member includes an upper bearing surface and camming end portion which which engages a channel in the frame of the enclosure and aids in aligning and retaining the slave door in a closed position.

15 Claims, 8 Drawing Sheets

U.S. PATENT DOCUMENTS

| | | |
|---|---|---|
| 4,036,039 | 7/1977 | Nakanishi . |
| 4,186,952 | 2/1980 | Glass . |
| 4,205,867 | 6/1980 | Loikitz . |
| 4,311,317 | 1/1982 | Bartels . |
| 4,325,239 | 4/1982 | Larson . |
| 4,331,413 | 5/1982 | Hoen . |
| 4,563,885 | 1/1986 | Madden . |
| 4,616,864 | 10/1986 | Douglas . |
| 4,631,937 | 12/1986 | Debus et al. . |
| 4,657,462 | 4/1987 | Hoen . |
| 4,910,982 | 3/1990 | Dana . |
| 4,951,980 | 8/1990 | Wetzel . |
| 4,995,652 | 2/1991 | Mugnolo et al. . |
| 5,123,683 | 6/1992 | Solovieff . |
| 5,172,944 | 12/1992 | Munich et al. . |
| 5,253,917 | 10/1993 | Brueggemann . |
| 5,265,924 | 11/1993 | Kim . |
| 5,413,392 | 5/1995 | Schlack et al. . |
| 5,481,889 | 1/1996 | Richard et al. . |
| 5,509,703 | 4/1996 | Lau et al. . |
| 5,630,632 | 5/1997 | Swan . |

OTHER PUBLICATIONS

Cover page of DECO brochure, dated Apr. 1993, showing a latch handle.

EMKA Swinghandle Leaflet (5 pgs.), undated.

EMKA Screw–in Quarter Turn Leaflet (2 pgs.), undated.

Austin Hardware, Quarter Turn Fasteners Leaflet (2 pgs.), undated.

Eberhard Dead Bolt Latches, Quarter Turn Leaflet (2 pgs.), undated.

Normont Industrial Hardware, Quarter Turn, Screw–In Type Leaflet (2 pgs.), undated.

Paneloc High–Performance Quarter–Turn Fasteners Leaflet (2 pgs.), Nov. 1987.

Southco Fasteners, Vise–action™ Latch Leaflet (2 pgs.), undated.

CABINET LATCH

BACKGROUND OF THE INVENTION

1. Field of the Invention

The present invention relates to a door latch for a cabinet and in particular, to a latch that is reversibly mountable, substantially hidden from view when engaged, and provides alignment of the door.

2. Prior Art

Cabinets such as for electrical equipment typically have opposed doors hinged along an outer vertical edge which close and latch along a center line. Such doors typically latch together along their center line with a latch handle at approximately the midpoint of the doors. The doors typically overlap slightly, the outer door being referred to as the "Master" door and the covered door being referred to as the "Slave" door. The handle may include a linkage for engaging the cabinet frame at both the top and bottom for improved multipoint latching.

However, it can be appreciated that improved latching is accomplished with independently actuatable latches placed at both the top and bottom of the doors. In particular, it can be appreciated that the slave door, the door which must be closed first, should be latchable to improve cabinet rigidity and door alignment. Having the first closed door retained also improves the safety and ease of use for closing the second door and aligning the latching system. It can also be appreciated that for aesthetic reasons, such a latch should be hidden and easily mountable to the inside of the slave door. By hiding the latches, it is also easier to maintain edge seals and create a dust free sealed enclosure.

It can be seen then, that a new improved latch for a double door cabinet is needed. Such a latch should be easily mountable to provide a sealed interior by latching at both the top and bottom of the door. Such a latch should be reversible to mount to either left-handed or right-handed opening doors at either the top or bottom. In addition, such a latch should provide for being hidden from view when both doors are closed for improved aesthetics. The latch should also provide for alignment at both the top and bottom. The present invention addresses these as well as other problems associated with cabinet door latches.

SUMMARY OF THE INVENTION

The present invention is directed to a latch device, and in particular, to a latch device for an enclosure having a master door and a slave door. The latch is configured for mounting to a flange on a slave door near the top and/or bottom edge for independently engaging the frame of the enclosure.

The latch device includes a handle portion and an engaging portion extending at substantially right angles to one another. The handle includes a grip portion having an orifice formed therethrough configured for receiving the fingers of the hand. The engaging portion includes a bearing member having an upper bearing surface configured for sliding along the inside of the door and an end bearing surface having a rounded cam portion. The rounded cam is configured for engaging the channel of the enclosure's frame. The rounded cam portion also aligns and positions the slave door relative to the enclosure frame to prevent misalignment and sagging. Two latches may be utilized to latch at both the upper and lower edge of a door for greater rigidity.

The latch is configured so that the handle portion and the rounded cam surface are exposed when in an unengaged position. However, in the engaged position, the handle substantially slides into the channel of the frame and is hidden from a viewer looking from outside of the enclosure. This provides a more aesthetically pleasing appearance for the device. In addition, the engaging portion is configured for Age accepting the bearing member in either a left or right handed configuration so that the latch device may mount to either a left handed or right handed door at either the top or bottom without requiring separate left handed and right handed parts.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding structure throughout the several views.

DETAILED DESCRIPTION OF THE PREFERRED EMBODIMENT

Figure 1:
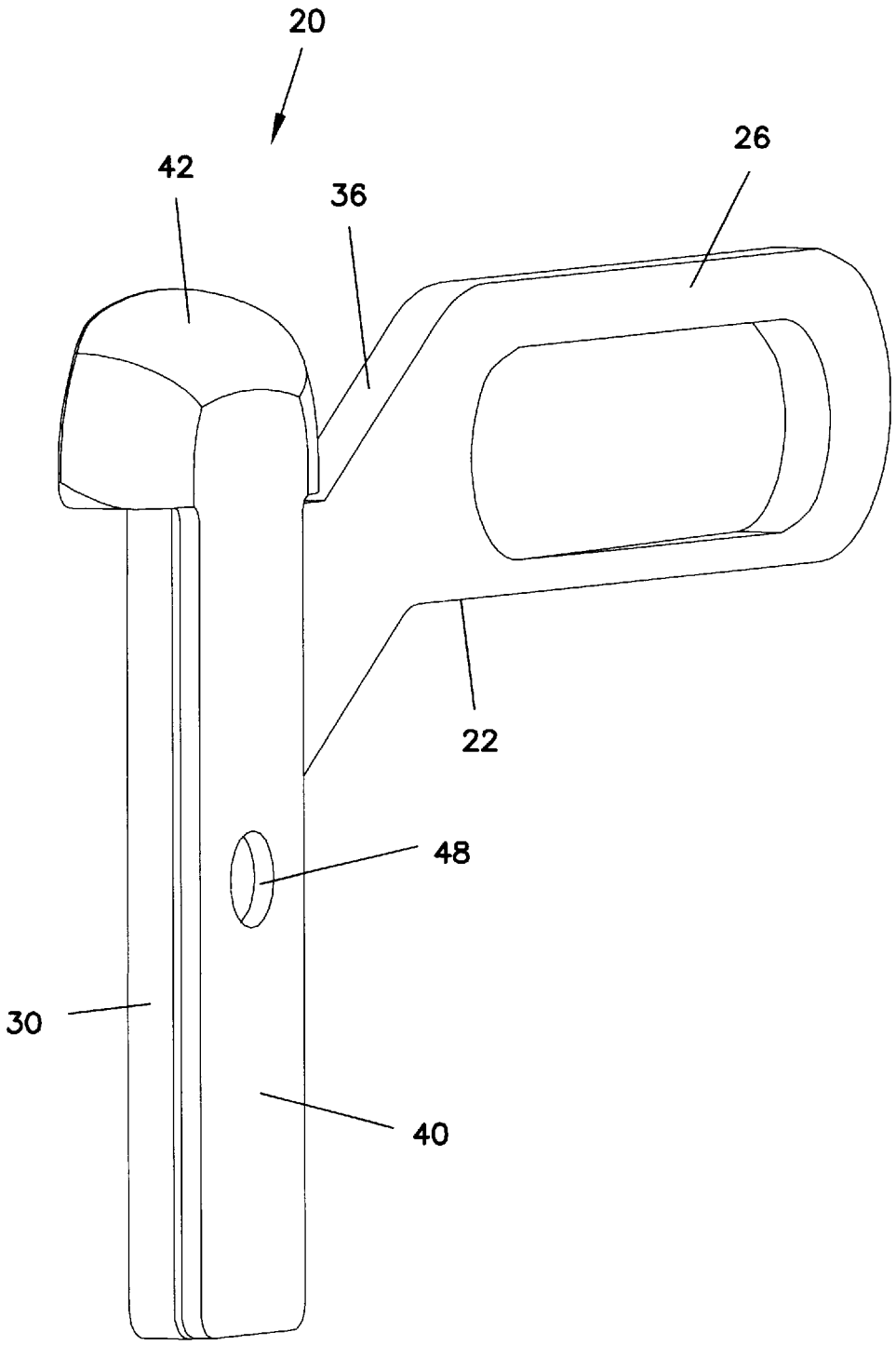
FIG. 1 shows a front perspective view of a cabinet latch according to the principles of the present invention.
Figure 2:
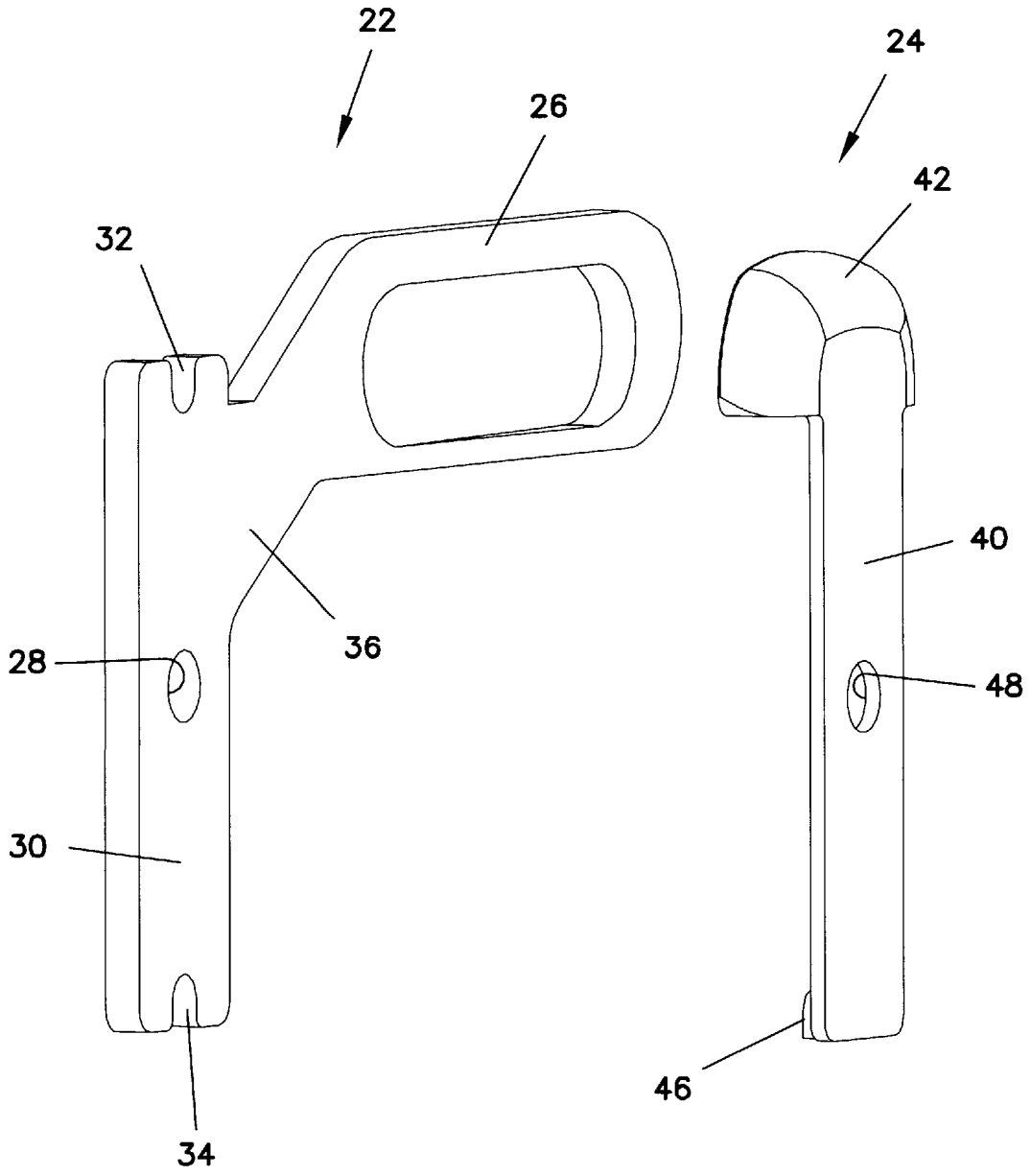
FIG. 2 shows an exploded perspective view of the cabinet latch shown in FIG. 1.
Figure 3:
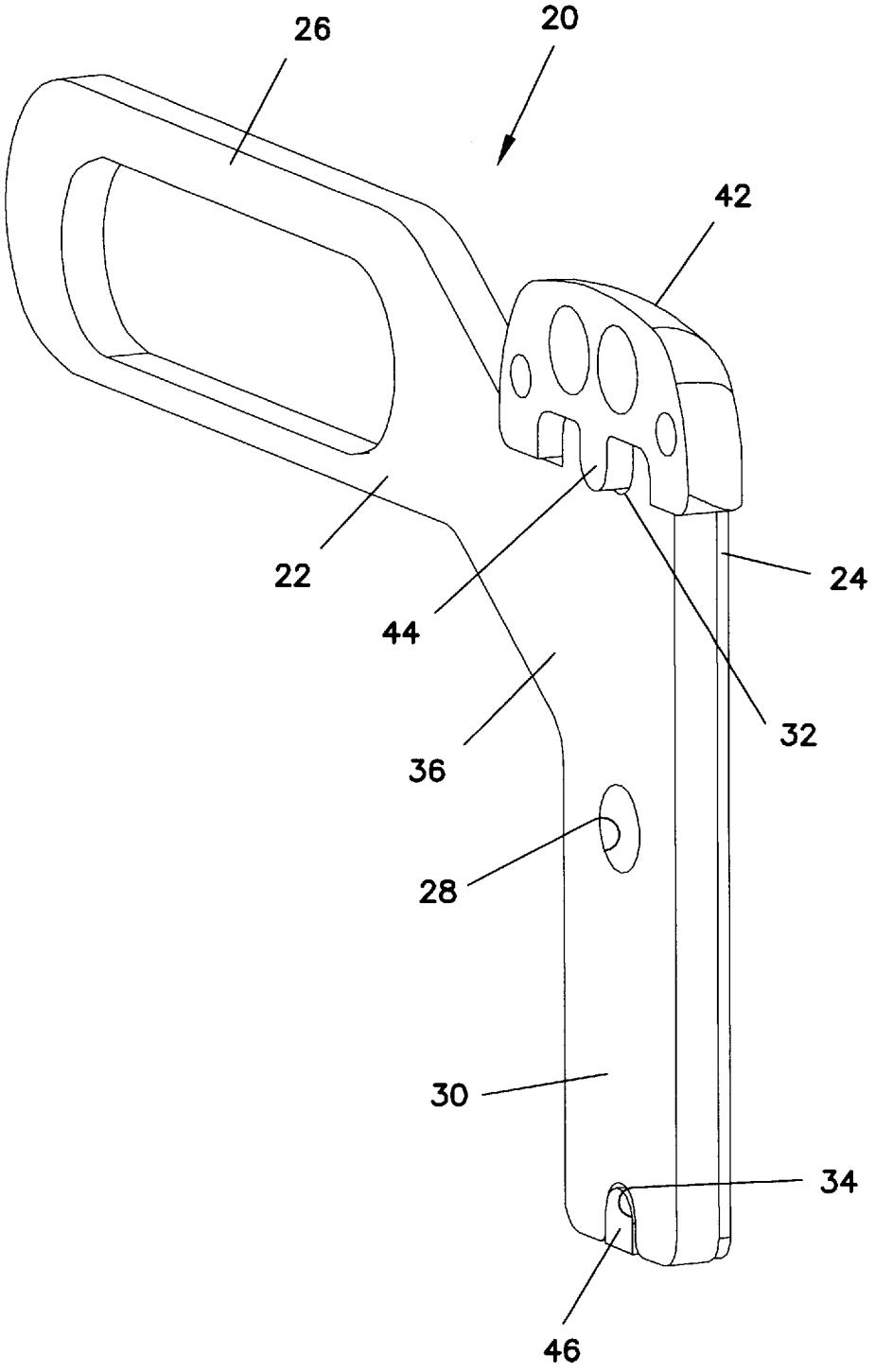
FIG. 3 shows a rear perspective view of the cabinet latch shown in FIG. 1.

Referring now to the drawings, and in particular to FIG. 1, there is shown a cabinet door latch device, generally designated 20. As also shown in FIGS. 2 and 3, the latch device 20 includes a handle member 22 and a bearing member 24. The handle member 22 attaches to the bearing member 24 in a reversible fashion for mounting to either left or right handed doors. The handle member 22 includes a grip portion 26 as well as an alignment portion 30 having recesses 32 and 34 formed at opposing ends. The alignment portion 30 also includes a mounting orifice 28 for receiving a mounting member such as a screw or bolt for attaching the bearing member 24 and for mounting to the enclosure. An angled connecting portion 36 extends between the grip portion 26 and the aligning portion 30.

The bearing member 24 includes an upper planar bearing surface 40 for engaging the interior of the slave door. The bearing member 24 is preferably made from a low friction material, such as plastic. At one end is formed a "T" shaped rounded camming surface 42 which includes an angled, rounded portion around the cross portion of the "T" end which is used for aligning and positioning the latch and the slave door, as explained hereinafter. The camming surface 42 arcs laterally a nd perpendicularly to the upper bearing surface 40. The bearing member 24 includes an orifice 48 extending therethrough for mounting. The orifice 48 is aligned with the mounting orifice 28 and receives a bolt or other mounting hardware and which serves as a pivot point. The underside of the bearing member includes tab like alignment members 44 and 46, shown most clearly in FIG. 7, that engage the recesses 32 and 34 at the ends of the alignment portion 30 of the handle member 22. The alignment members 44 and 46 are configured for reversibly mounting and aligning the bearing members 24 to the handle member 22. The handle member 22 may be turned over to mount in either a left or right extending mounting arrangement.

Figure 4:
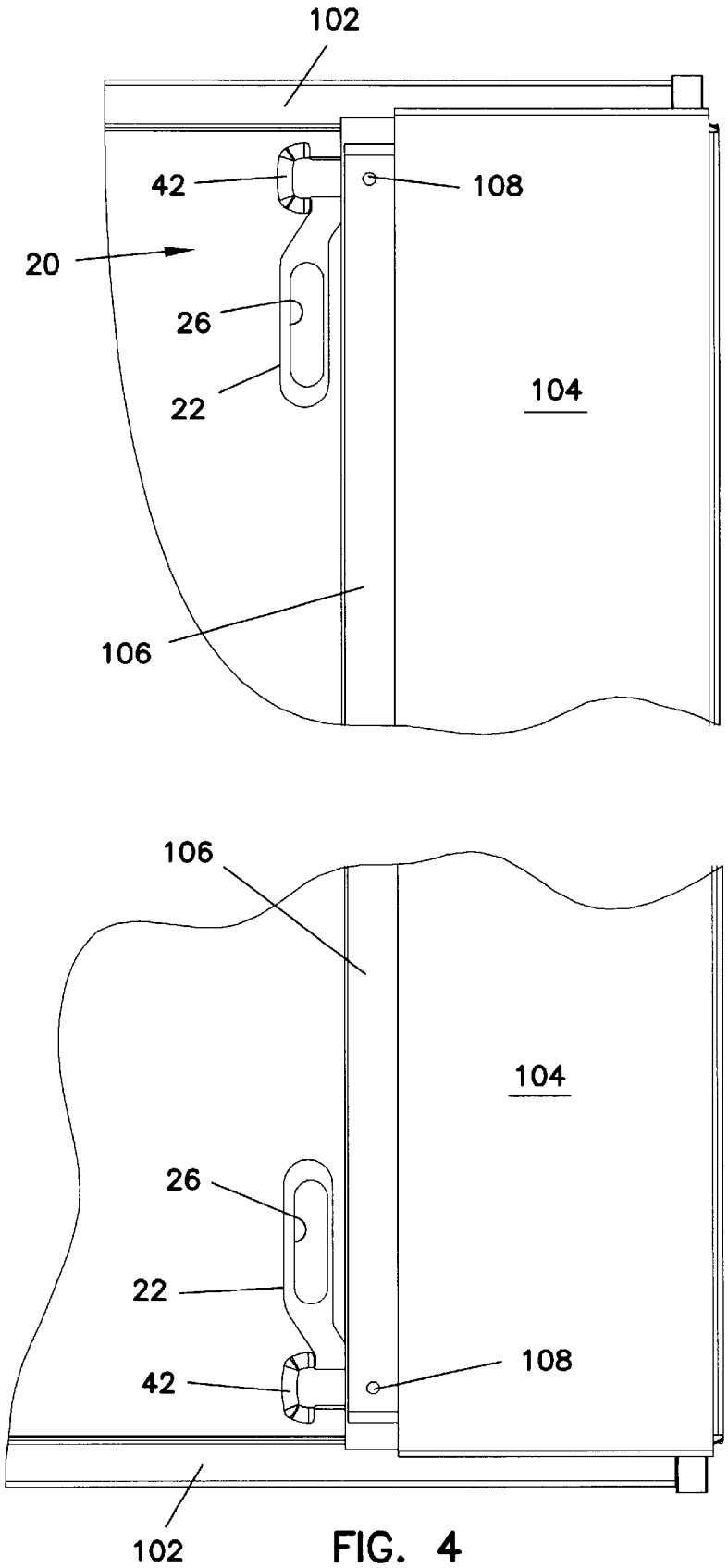
FIG. 4 shows a partial front elevational view of a slave door having the cabinet latches shown in FIG. 1 mounted thereon at the upper and lower edge in an unengaged position.
Figure 5:
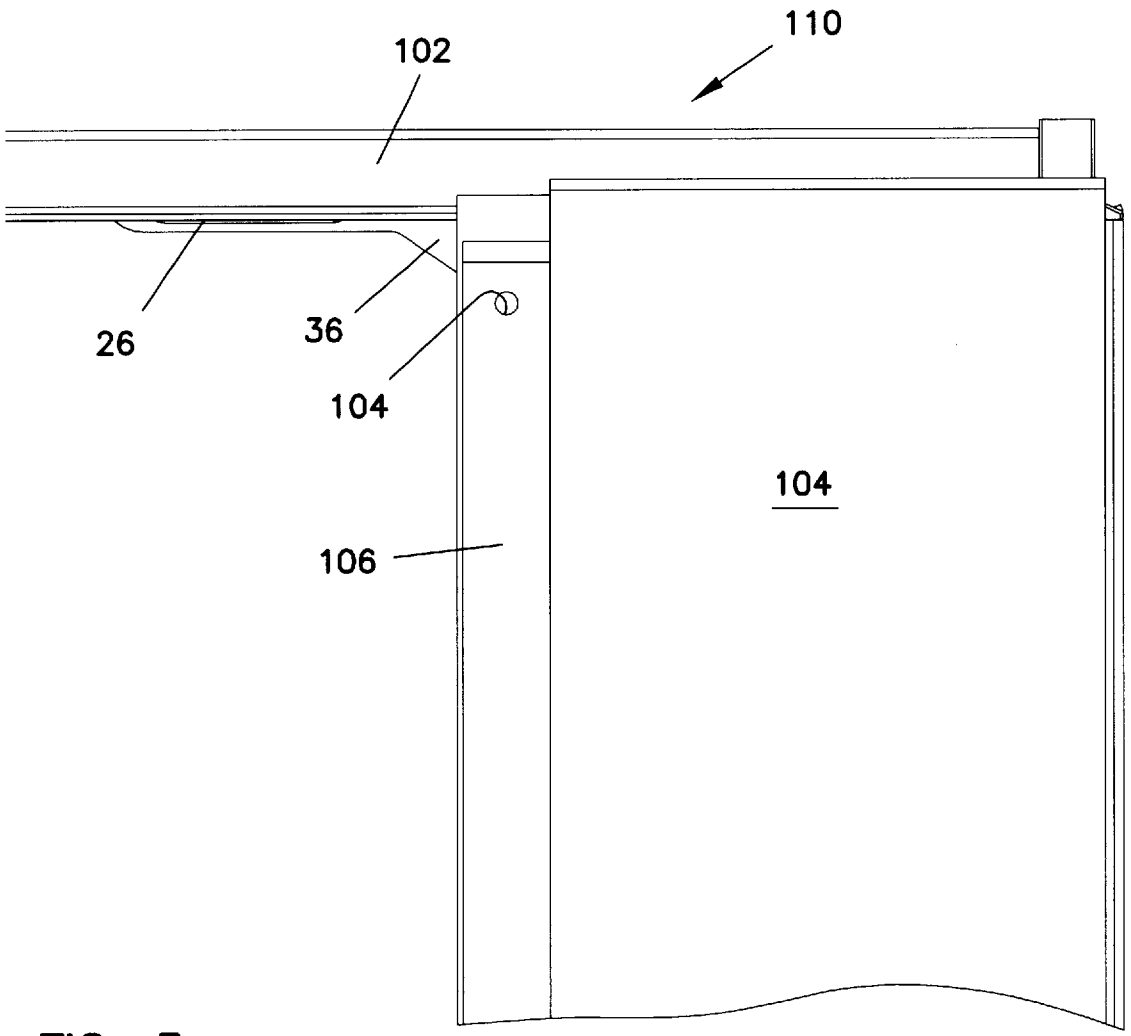
FIG. 5 shows a partial detail view of the slave door shown in FIG. 4 with the cabinet latch in an engaged position.
Figure 6:
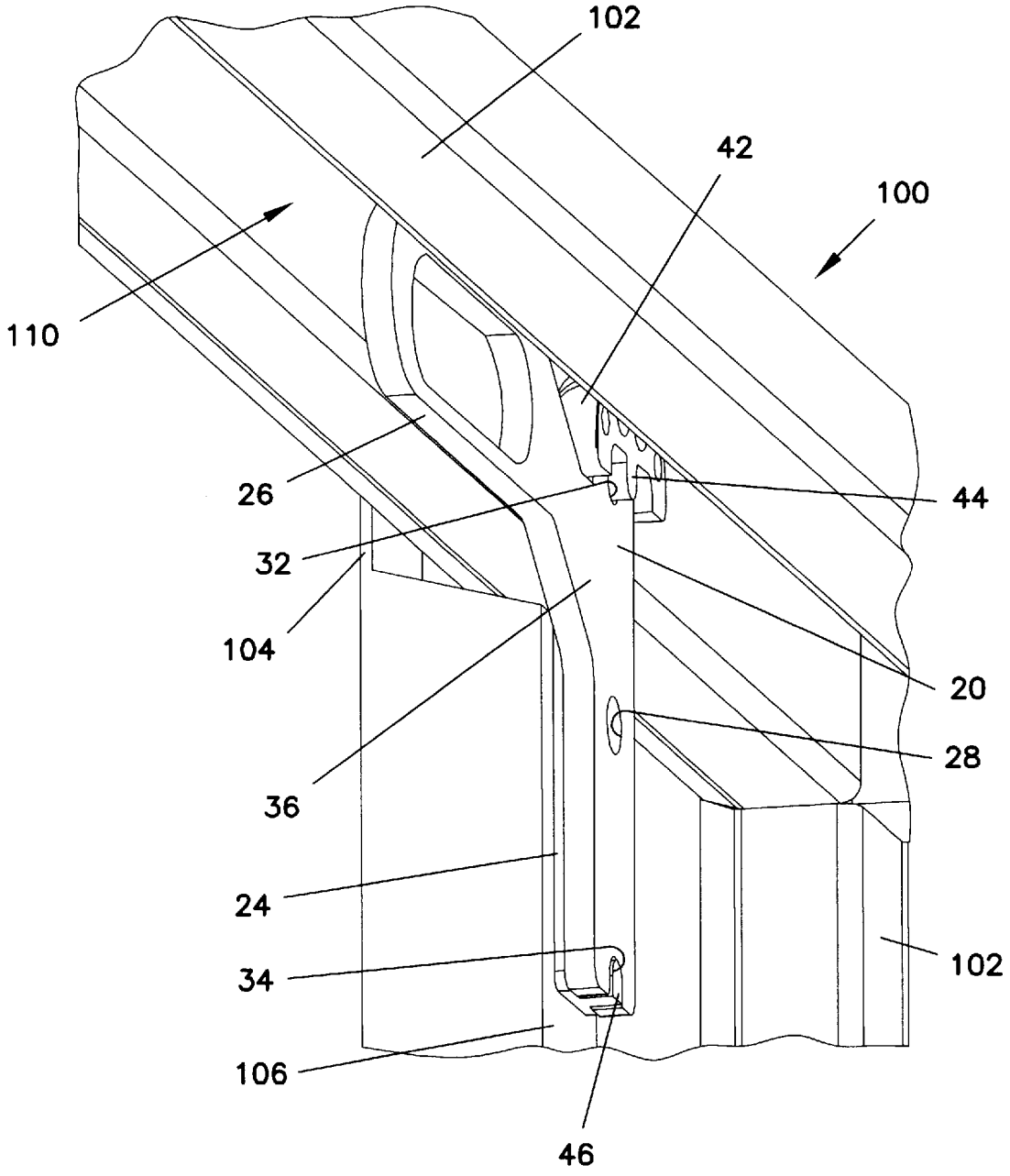
FIG. 6 shows an inner perspective view of a cabinet with the cabinet latch handle shown in FIG. 1 in a closed position.
Figure 7:
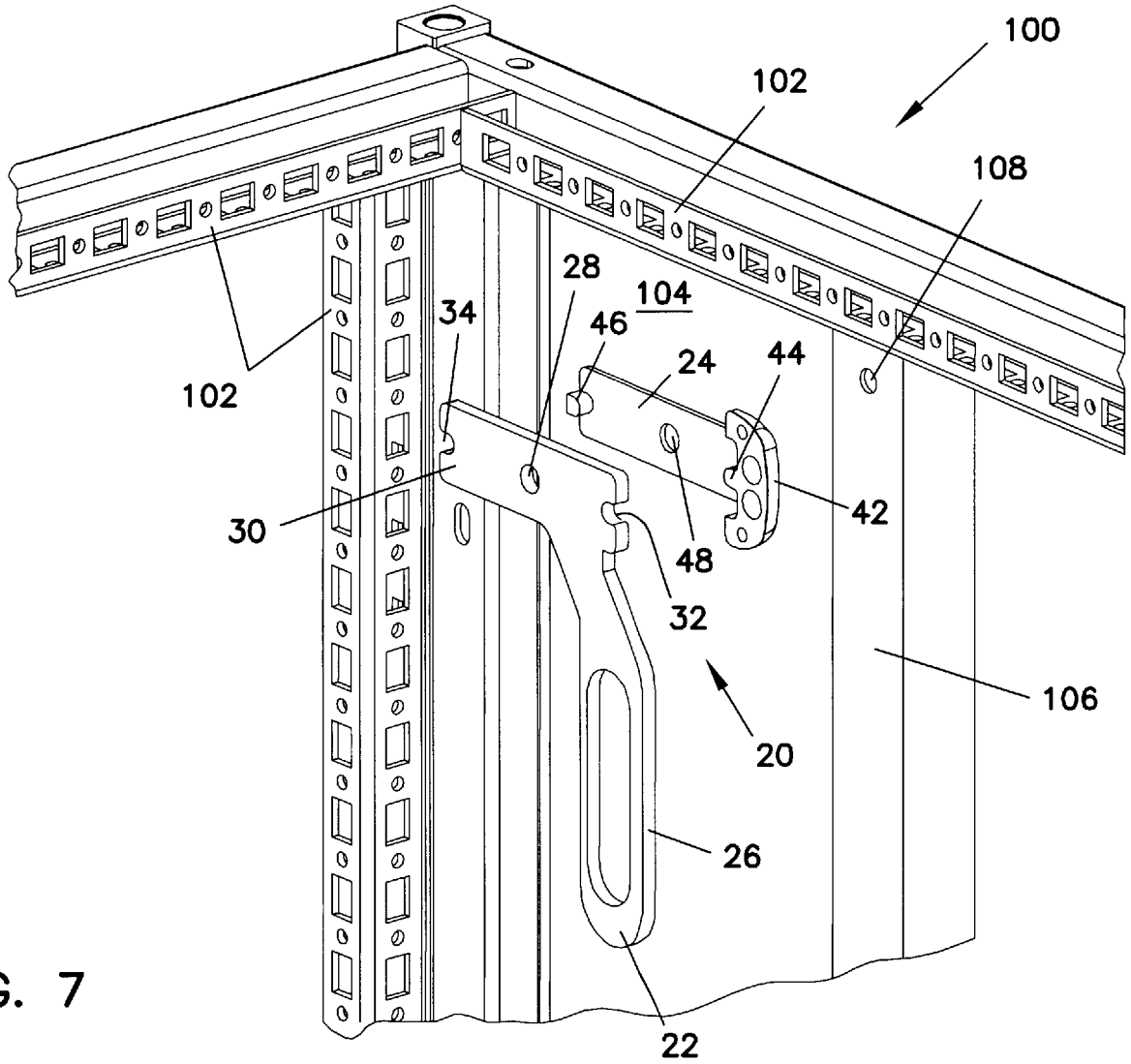
FIG. 7 shows an inner perspective view of a cabinet and frame and an exploded view of the cabinet latch handle shown in FIG. 1; and, FIG. 8 shows a partially broken away view of th e cabinet frame and slave door with the cabinet latch handle shown in FIG. 1 in an engaged position.

Referring now to FIGS. 4–6, the latch device 20 typically mounts to an enclosure 100 having a frame 102 around the door opening. The opening typically includes a slave door 104 which is covered along a flange 106 at an edge by a master door 112, shown in FIGS. 7 and 8. As shown in FIG. 4, the slave door 104 may have a latch device 20 mounted at either the top and/or the bottom edge at an edge flange portion 106. With this configuration, the latch device 20 may be utilized to secure the door 104 at the top and/or bottom depending upon the requirements of the enclosure. It can be appreciated that the enclosure frame 102 typically used for housing electrical equipment and includes a channel 110 and flanges have spaced openings for mounting and/or grounding electrical components, enclosure panels or other devices such as may be required. As shown in FIG. 7, the latch 20 mounts to the flange 106 of the slave-door 104, mounting through and aligning with a mounting orifice 108 in the slave door.

Figure 8:
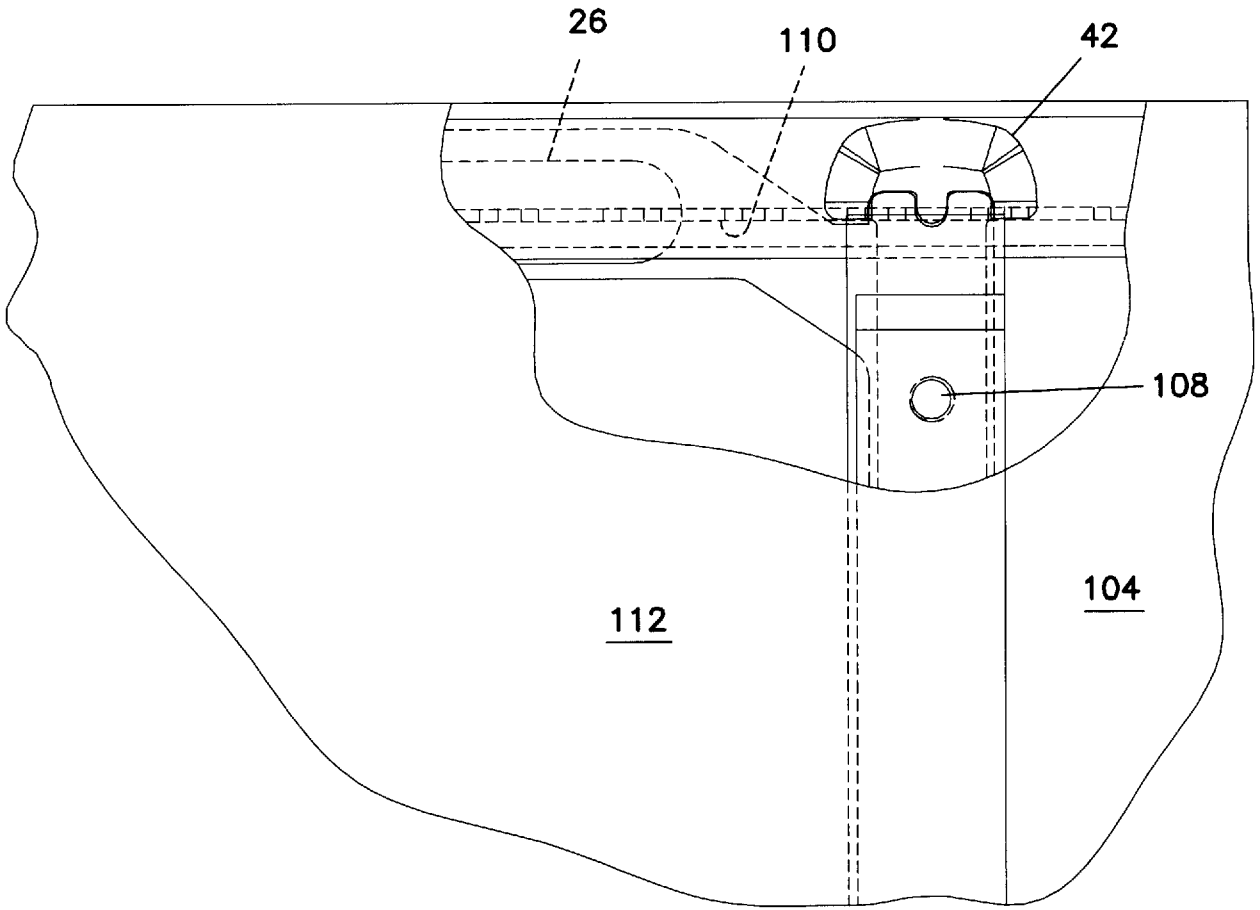

As shown in FIG. 4, when the master door is open and the latch devices 20 are not engaged, the handle member 22 as well as the bearing camming surface 42 are exposed and easily viewed. The grip portion 26 of the handle members 22 extends beyond the edge of the flange 106 of the slave door 104 and can be easily gripped. The visibility of the grip 26 serves as an indication that the latch 20 is not engaged at this position. The latch 20 can be moved to the closed position as shown in FIGS. 5, 6 and 8 by rotating the handle member 22 toward the channel 110 of the enclosure frame 102. When the latch 20 is in the engaged position, it is substantially covered by the frame 102 and the flange 106 as shown in FIG. 5. This presents an aesthetically pleasing appearance when viewed from the usual exterior of the enclosure 100. The substantially entirely hidden portion of the latch 20 also is a clear indication that the latch is in a fully engaged position. As shown in FIG. 8, when the slave door 104 and master door 112 are both closed, the latch 20 is entirely hidden.

As shown in FIG. 6, although the latch 20 is engaged but substantially hidden from view, it can be appreciated that the grip portion 26 may still be easily accessed by inserting the fingers into the channel 110 and through the opening of the grip portion 26. The latch 20 is rotated to the fully disengaged position, shown in FIG. 4, allowing the slave door 104 to be opened.

As shown in FIG. 8, the latch 20 also serves as an alignment member. The edge of the camming surface 42 engages the edge of the channel 110 to position the slave door 104 in the correctly aligned position. It can be appreciated that positioning the latch 20 at the bottom of the door, as shown in FIG. 4, prevents the common problem of sagging among side pivoting enclosure doors. Should the slave door 104 be tilted slightly off center and be too high, the upper latching device 20 will reposition the slave door 104 in a correctly aligned position, as shown in FIG. 8.

It can also be appreciated that the upper bearing surface 40 slides substantially freely along the underside of the typically painted inner surface of the slave door 104 and provides for easy pivoting between the engaged and disengaged positions. The rounded camming surface 42 also helps to guide the latch into the channel 110 with less force being required. The position of the grip portion 26 also provides a mechanical advantage for latching and guiding the camming surface 42.

It is to be understood, however, that even though numerous characteristics and advantages of the present invention have been set forth in the foregoing description, together with details of the structure and function of the invention, the disclosure is illustrative only, and the changes may be made in detail, especially in matters of shape, size and arrangement of parts within the principles of the invention to the full extent indicated by the broad general meaning of the terms in which the appended claims are expressed.

What is claimed is:

1. A latch apparatus rotating about a rotational axis, comprising:

a grip portion at a first side of the rotational axis having a first end and a second end and a longitudinal axis perpendicular to the rotational axis;

a planar actuator portion at a second side of the rotational axis having a first end and a second end and a longitudinal axis extending substantially perpendicular to the longitudinal axis of the grip portion and the rotational axis;

a connector portion extending intermediate the first end of the grip portion and the first end of the actuator portion; and, a bearing member having a camming surface, wherein the bearing member is mounted to the actuator portion and includes a bearing surface tangent the camming surface, wherein the bearing member is mountable to either side of the actuator portion to reverse the latch apparatus.

2. A latch apparatus according to claim 1, wherein the camming surface arcs outward along the axis of the actuator portion and the grip portion.

3. A latch apparatus according to claim 2, wherein an outer edge of the grip portion substantially aligns with an edge of the camming surface.

4. A latch apparatus according to claim 1, wherein the bearing surface is tangent the camming surface.

5. A latch apparatus comprising:

a planar grip portion having a first end and a second end and a longitudinal axis;

a planar actuator portion having a first end and a second end and a longitudinal axis extending substantially perpendicular to the longitudinal axis of the grip portion;

a connector portion extending intermediate the first end of the grip portion and the first end of the actuator portion; and a T-shaped bearing member having a planar bearing surface and a camming surface, wherein the bearing member is mounted to the actuator portion and the camming surface extends laterally from a longitudinal direction of the bearing member.

6. A latch apparatus rotating about a rotational axis, comprising a grip portion at a first side of the rotational axis having a first end and a second end and a longitudinal axis perpendicular to the rotational axis, a planar actuator portion at a second side of the rotational axis having a first end and a second end and a longitudinal axis extending substantially perpendicular to the longitudinal axis of the grip portion and the rotational axis;

a connector portion extending intermediate the first end of the grip portion and the first end of the actuator portion;

a bearing member having a camming surface, wherein the bearing member is mounted to the actuator portion;

wherein the bearing member is reversibly mountable to the planar actuator portion so that the camming surface is proximate a first face of the actuator portion in a first position and proximate a second face of the actuator portion in the second position.

7. A latch apparatus according to claim 6, wherein the bearing member mounts to either side of the actuator portion for reversing the actuation direction.

8. A rotatable latch apparatus, comprising:

a grip having a longitudinal axis;

a T-shaped planar actuator having a first end and a second end and a longitudinal axis extending substantially perpendicular to the longitudinal axis of the grip;

a connector portion having a rotational axis extending therethrough, wherein the connector portion is intermediate the grip and the first end of the actuator; and a camming surface at the first end of the actuator;

wherein the first end of the T-shaped actuator provides alignment for the latch apparatus.

9. A latch apparatus according to claim 8, wherein the actuator includes a planar bearing surface.

10. A latch apparatus according to claim 9, wherein the bearing surface is tangent the camming surface.

11. A latch apparatus according to claim 8, wherein the rotational axis is perpendicular to the longitudinal axes of the actuator and the grip.

12. A rotatable latch according to claim 8, wherein the camming surface comprises an arcing exterior surface.

13. A rotatable latch according to claim 7, wherein the actuator includes a bearing member having a planar bearing surface perpendicular to the rotational axis.

14. A rotatable latch apparatus according to claim 8, wherein the grip portion defines an oval opening therein adapted for receiving a user's fingers.

15. A rotatable latch according to claim 8, wherein the grip comprises a planar member coplanar with the actuator.

* * * * *

UNITED STATES PATENT AND TRADEMARK OFFICE

CERTIFICATE OF CORRECTION

PATENT NO. : 5,879,035

DATED : MARCH 9, 1999

INVENTOR(S) : JANCSEK ET AL.

It is certified that error appears in the above-identified patent and that said Letters Patent is hereby corrected as shown below:

On the title page: Item

[56] References Cited, Foreign Patent Documents: "Anguilla" should read —Austria—

[56] References Cited, Foreign Patent Documents: "of 1907" should read —5/1907—

[57] Abstract, line 5: delete second occurrence of "which"

Col. 2, line 5: delete "Age"

Col. 3, line 5: "a nd" should read —and—

Col. 6, line 18, claim 13: "claim 7" should read —claim 8—

Signed and Sealed this

Twenty-sixth Day of September, 2000

*Attest:*

Q. TODD DICKINSON

*Attesting Officer*

*Director of Patents and Trademarks*